US005645486A

United States Patent [19]

Nagao et al.

[11] Patent Number: 5,645,486

[45] Date of Patent: Jul. 8, 1997

[54] GAMING SYSTEM THAT PAYS OUT A PROGRESSIVE BONUS USING A LOTTERY

[75] Inventors: Yuji Nagao; Keiji Yano, both of Tokyo, Japan

[73] Assignee: Sega Enterprises, Ltd., Japan

[21] Appl. No.: 518,342

[22] Filed: Aug. 23, 1995

Related U.S. Application Data

[63] Continuation-in-part of Ser. No. 348,243, Nov. 28, 1994, abandoned.

[30] Foreign Application Priority Data

Nov. 30, 1993 [JP] Japan ..... 5-326345

[51] Int. Cl.[6] ..... A63F 9/24

[52] U.S. Cl. ..... 463/27

[58] Field of Search ..... 463/27, 26, 25, 463/17, 16, 13, 12, 42; 273/138 A, 832 P, 143 R

[56] References Cited

U.S. PATENT DOCUMENTS

| | | | |
|---|---|---|---|
| 4,624,459 | 11/1986 | Kaufman | 463/27 X |
| 4,652,998 | 3/1987 | Koza et al. | 463/26 |
| 4,837,728 | 6/1989 | Barrie et al. . | |
| 5,116,055 | 5/1992 | Tracy | 463/27 |
| 5,318,298 | 6/1994 | Kelly et al. | 463/27 X |
| 5,542,669 | 8/1996 | Charron | 463/13 |

*Primary Examiner*—Jessica Harrison
*Assistant Examiner*—Michael O'Neill
*Attorney, Agent, or Firm*—Dickstein Shapiro Morin & Oshinsky LLP

[57] ABSTRACT

A progressive gaming system pays out a progressively increasing bonus to a player who wins a game with a predetermined winning combination. The progressive gaming system includes a plurality of gaming controllers which detect when a player gets one of a plurality of predetermined winning combinations and pays out a predetermined number of coins or tokens according to the winning combination. Each of the gaming controllers counts coins or tokens bet by the player before the game is started and outputs an indication signal of the amount of the bet coins or tokens. The progressive gaming system further includes an master controller operatively connected to the plurality of gaming controllers, which adds a predetermined percentage of the bet coins or tokens reported by each of the gaming controllers to a bonus value, performs a lottery when the player gets a predetermined winning combination, and controls each of the gaming controllers to pay out coins or tokens corresponding to a predetermined reward for the predetermined winning combination and saved bonus value.

34 Claims, 17 Drawing Sheets

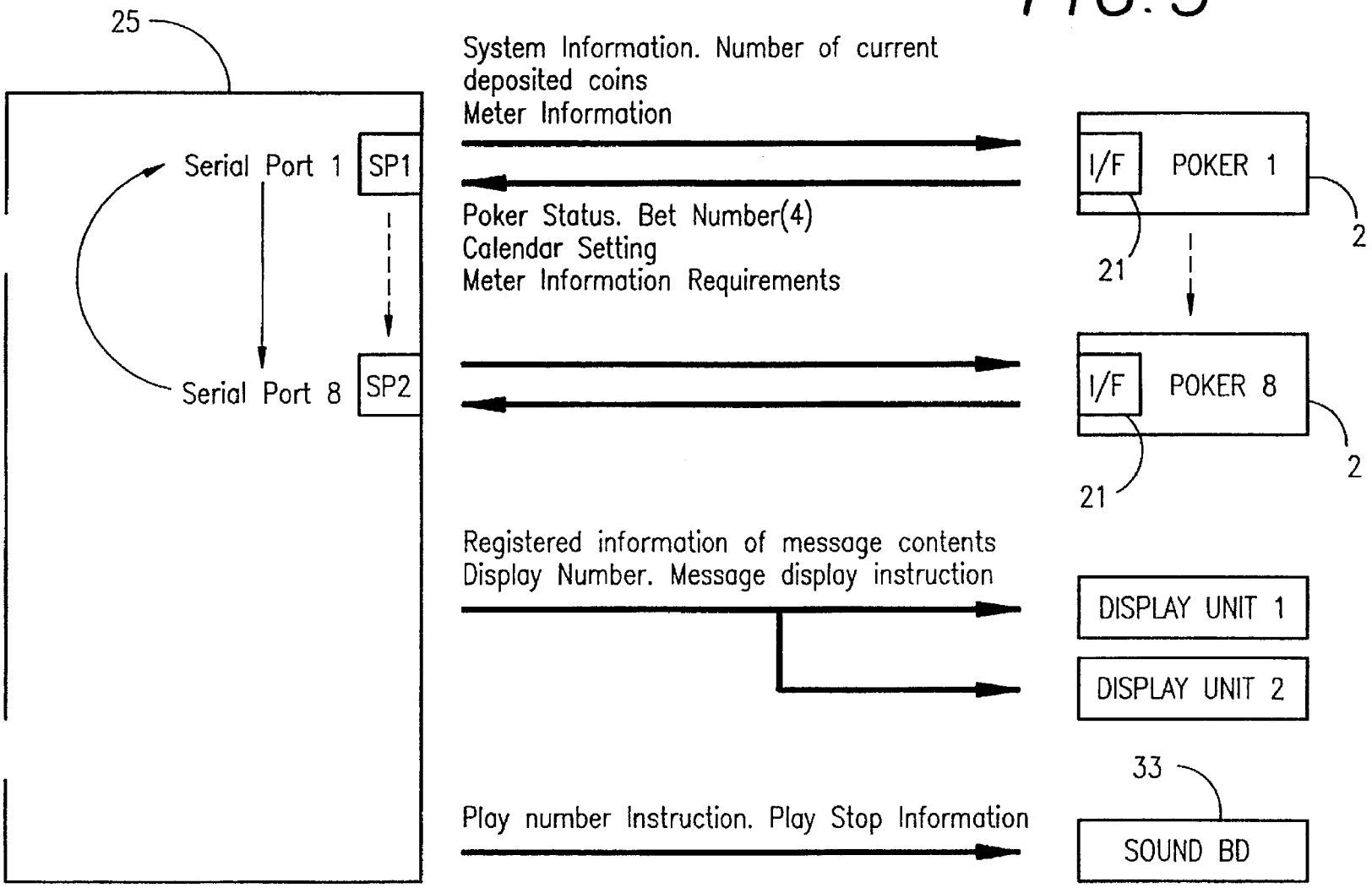
FIG. 3
25
Serial Port 1
SP1
Serial Port 8
SP2
System Information. Number of current deposited coins
Meter Information
Poker Status. Bet Number(4)
Calendar Setting
Meter Information Requirements
Registered information of message contents
Display Number. Message display instruction
Play number Instruction. Play Stop Information
I/F
POKER 1
2
21
I/F
POKER 8
2
21
DISPLAY UNIT 1
DISPLAY UNIT 2
33
SOUND BD

| STX | Poker ID | Command | DATA Length | DATA | ETX | CRC |
|---|---|---|---|---|---|---|

FIG. 7

| STX | Poker ID | Command | ENQ |
|---|---|---|---|

FIG. 8

| Y 1 BYT | M 1 BYT | D 1 BYT | H 1 BYT | MT 1 BYT | S 1 BYT |
|---|---|---|---|---|---|

FIG. 9

| System status | Royal Coin | Double Coin | Jackpot Poker ID | Received Packet No. |
|---|---|---|---|---|
| 1 BYTE | 4 BYTE | 4 BYTE | 1 BYTE | 1 BYTE |

FIG. 10

FIG. 11A

| ITEM | Byte |
|---|---|
| Display 1, number of coin | 6 |
| Display 2, number of coin | 6 |
| Deposit 1, number of coin | 6 |
| Deposit 2, number of coin | 6 |
| All BET number | 4 |
| All Double number | 4 |
| All Internal Amendment number | 4 |
| All PUSH number | 4 |
| All WAGER | 4 |
| All TAKE | 4 |
| Display 1, number per a lottery | 4 |
| Display 2, number per a loterry | 4 |
| Big Ban, number per a lottery | 4 |
| All ROYAL JP, paid number | 4 |
| All DOUBLE JP, paid number | 4 |
| Today's BET number | 4 |
| Today's DOUBLE number | 4 |
| Today's internal amended value number | 4 |
| Today's PUSH number | 4 |
| Today's WAGER | 4 |
| Today's TAKE | 4 |
| Display 1, Today's number per lottery | 4 |
| Display 2, Today's number per lottery | 4 |
| Big Ban, Today's number per lottery | 4 |
| ROYAL JP, Today's paid number | 4 |
| DOUBLE JP, Today's paid number | 4 |
| Times of generating ROYAL JP | 4 |
| Times of generating DOUBLE JP | 4 |
| Display 1, Total lottery times | 4 |
| Display 2, Total lottery times | 4 |
| Times of generating JP (ROYAL) | 4 |
| Times of generating JP (DOUBLE) | 4 |
| Progressive 1, Total lottery times | 4 |

FIG. 11B

| | |
|---|---|
| Times per 500 coins | 4 |
| Times per 200 coins | 4 |
| Times per 100 coins | 4 |
| Times per 50 coins | 4 |
| Progressive 2, Total lottery Time | 4 |
| Times per 500 coins | 4 |
| Times per 200 coins | 4 |
| Times per 100 coins | 4 |
| Times per 50 coins | 4 |
| Times of generating Today's JP (ROYAL) | 4 |
| Times of generating Today's JP (DOUBLE) | 4 |
| Today's Progressive 1, Total lottery times | 4 |
| Today's times per 500 coins | 4 |
| Today's times per 200 coins | 4 |
| Today's times per 100 coins | 4 |
| Today's times per 50 coins | 4 |
| Big Ban number | 4 |
| Over limit 1 | 4 |
| Over limit 2 | 4 |
| Big Ban Debt | 4 |
| Year | 1 |
| Month | 1 |
| Day | 1 |
| Hour | 1 |
| Minute | 1 |
| Second | 1 |
| ROYAL overlimit | 4 |
| DOUBLE overlimit | 4 |
| Number of Double Progressive obtain condition | 2 |
| Number of starting production | 2 |
| Existance of sound | 1 |
| Pay out Pattern Number (0 to 7) | 1 |

| Y | M | D | H | MT | S | COMB. | Poker No. | Jackpot Numbers |
|---|---|---|---|---|---|---|---|---|
| 1 BYTE | 1 BYTE | 1 BYTE | 1 BYTE | 1 BYTE | 1 BYTE | 1 BYTE | 1 BYTE | 4 BYTE |

×25

FIG. 12

| Packet No. | Mode | BET | Double | Internal Amendment | BANK | BigBang | COMB. NO. | PayOut |
|---|---|---|---|---|---|---|---|---|
| 1 BYTE | 1 BYTE | 2 BYTE | 2 BYTE | 2 BYTE | 2 BYTE | 1 BYTE | 1 BYTE | 4 BYTE |

FIG. 13

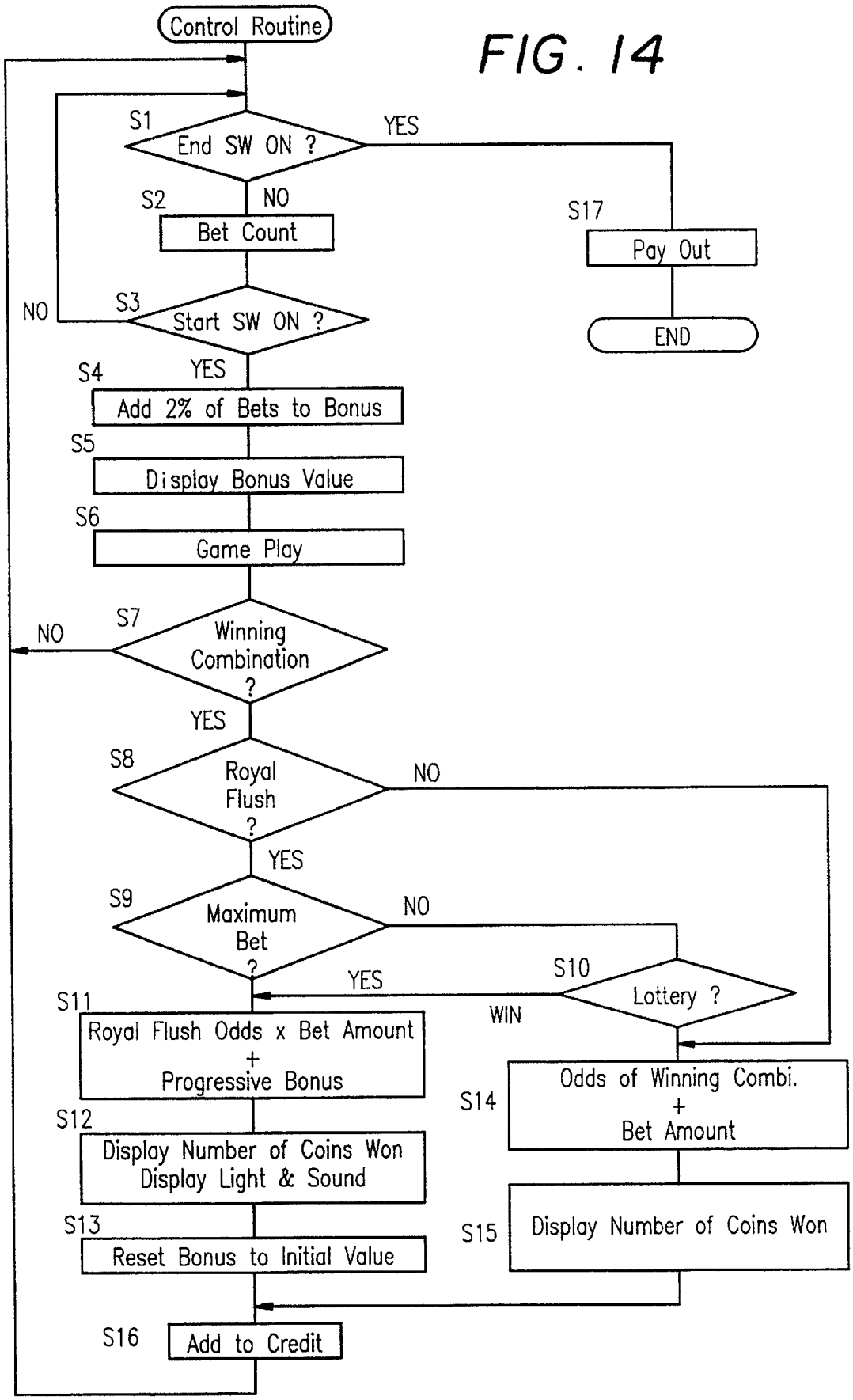
FIG. 14
Control Routine
S1
End SW ON ?
YES
NO
S2
Bet Count
S17
Pay Out
END
NO
S3
Start SW ON ?
YES
S4
Add 2% of Bets to Bonus
S5
Display Bonus Value
S6
Game Play
NO
S7
Winning Combination ?
YES
S8
Royal Flush ?
NO
YES
S9
Maximum Bet ?
NO
YES
S10
Lottery ?
WIN
S11
Royal Flush Odds x Bet Amount + Progressive Bonus
S12
Display Number of Coins Won Display Light & Sound
S13
Reset Bonus to Initial Value
S14
Odds of Winning Combi. + Bet Amount
S15
Display Number of Coins Won
S16
Add to Credit

FIG. 19

| Dividend | Odds, |
|---|---|
| 500 | 1/50 |
| 200 | 2/50 |
| 100 | 5/50 |
| 50 | 12/50 |
| 0 | 30/50 |

GAMING SYSTEM THAT PAYS OUT A PROGRESSIVE BONUS USING A LOTTERY

CROSS REFERENCE TO RELATED APPLICATION

This application is a continuation-in-part of application Ser. No. 08/348,243 filed Nov. 28, 1994, now abandoned.

BACKGROUND OF THE INVENTION

1. Field of the Invention

The present invention relates to a gaming system including a game which is started by inserting coins or tokens and which displays the game as it progresses under the control of a computer system.

More particularly, it relates to a gaming system that pays out a progressively increasing bonus to a player who wins with a predetermined winning combination.

2. Description of the Related Art

The above-described gaming system is called a progressive gaming system. A progressive gaming system is generally formed with a plurality of linked gaming devices, or machines (hereinafter referred to as gaming controllers), in which a game is started when a coin or a token (hereinafter referred to as a coin) is dropped into a coin slot of a gaming controller.

The progressive gaming system also collects a fixed percentage of a total number of coins dropped into each gaming controller, and the collected coins are deposited as a bonus to pay out to a player who wins with a predetermined winning combination.

One conventional progressive gaming system disclosed in U.S. Pat. No. 4,837,728 includes 6 to 10 gaming controllers as one group. The progressive gaming system disclosed in the U.S. patent includes a display that indicates to players increased values of the progressive bonus per each winning combination. The progressive bonus per each winning combination is increased by depositing a predetermined percentage of coins bet in each gaming controller, whenever the coins are dropped through the coin slot.

When a player wins the game with a predetermined E winning combination which calls for the payout of a progressive bonus, the winner wins the coins corresponding to the progressive bonus. After the progressive bonus is paid out, the progressive bonus value is reset to an initial value.

Another conventional progressive system disclosed in U.S. Pat. No. 5,116,055 links a plurality of different gaming controllers, each having a different play characteristic, e.g., different game playing machines (such as a slot gaming machine and a poker gaming machine), machines of different denominations, and machines of different hit frequencies (such as a slot gaming machine having three reels and a slot gaming machine having four reels).

In the embodiment disclosed in the above-described U.S. Pat. No. 5,116,055, four different gaming controllers are linked. Moreover, the system controls the different controllers in such a way that players can win equally on each of the different controllers. That is, each gaming controller is controlled to calculate a constant percentage of the total number of coins bet in the gaming controller from the number of bet coins, the inserted denomination, hit frequencies or progressive bonus, and to allocate the calculated value as a bonus.

Therefore, each of the gaming controllers should share the progressive bonus value, individually. When any one of several players wins with a predetermined winning combination that is subject to the payout of the progressive bonus, the winner can win the coins corresponding to the progressive bonus value, as a reward.

After the bonus is paid out to the winner, the progressive bonus value is reset to an initial value. However, although games are repeated by a plurality of players in the conventional progressive systems described in the above U.S. patents, the progressive bonus is increased by only a fixed percentage of coins dropped into gaming controllers.

Moreover, in other conventional progressive systems known by the present Applicants, only the player who wins with a predetermined winning combination can receive the progressive bonus by satisfying the conditions of the maximum bet which he/she made. Accordingly, the player who has not put in the maximum bet has no chance to receive the progressive bonus, even if he wins the predetermined winning combination.

That is, although a constant percentage of the collected coins is distributed into the progressive bonus, only the player who puts in a maximum bet has a chance to win the progressive bonus in the conventional progressive gaming systems described above, even though the coins bet by players who do not put in a maximum bet are also added to the bonus value. Therefore, it may be considered irrational to not give a chance to win a progressive bonus to all players who contribute to it, as in the conventional systems. That has become the reason of a significant loss of player interest in conventional progressive gaming systems.

SUMMARY OF THE INVENTION

It is therefore an object of the present invention to provide a progressive gaming system in which all players have a chance to receive the progressive bonus regardless of the number of coins that player bets—thus, overcoming the above-noted drawbacks of conventional progressive gaming systems.

It is a more specific object of the present invention to provide a progressive gaming system in which a lottery is performed with a winning probability corresponding to the amount of coins that a player has bet, so that all players have a chance to receive the progressive bonus in the lottery when getting the predetermined winning combination.

Further, it is another object of the present invention to provide a progressive gaming system in which a percentage of the progressively increasing bonus can be varied to maintain a player's interest.

It is a still another object of the present invention to provide a progressive gaming system in which the lottery is performed when the deposited coins reach a predetermined lottery starting value which is set randomly, and in which a dividend for winning at a certain probability is added to the progressive bonus, which, the progressive bonus being increased by the dividend, so that a player gets a chance to win an unexpected bonus in the lottery.

There and other objects, advantages and features of the present invention will become clear by the following description of preferred embodiments, which is provided in connection with the attached drawings.

BRIEF DESCRIPTION OF THE DRAWINGS

FIG. 3 is an explanatory diagram of data transfer between the main board and poker units of the control circuits shown in FIG. 2.

FIG. 7 shows an exemplary format of the data packet format used to transfer data between the main board and each poker unit.

FIG. 8 shows an exemplary format of the date pocket used when requesting data between the main board and each poker unit.

FIG. 9 shows data sent from the main board according to a setting information request of the poker unit.

FIG. 10 shows data sent from the main board according to a display content sending request of the poker unit.

FIGS. 11A and 11B show data sent from the main board according to a meter content sending request of a poker unit.

FIG. 12 shows data sent from the main board according to a last game sending request of the poker unit.

FIG. 13 shows data sent from the poker unit according to a status monitoring command sent from the above-described master controller.

FIG. 14 shows an exemplary operation flow chart for realizing a first feature of the present progressive gaming system.

FIG. 19 is a table for explaining an embodiment for realizing the second feature of the present invention.

DESCRIPTION OF PREFERRED EMBODIMENTS

Preferred embodiments of the present invention will be explained in conjunction with the accompanying drawings.

Figure 1:
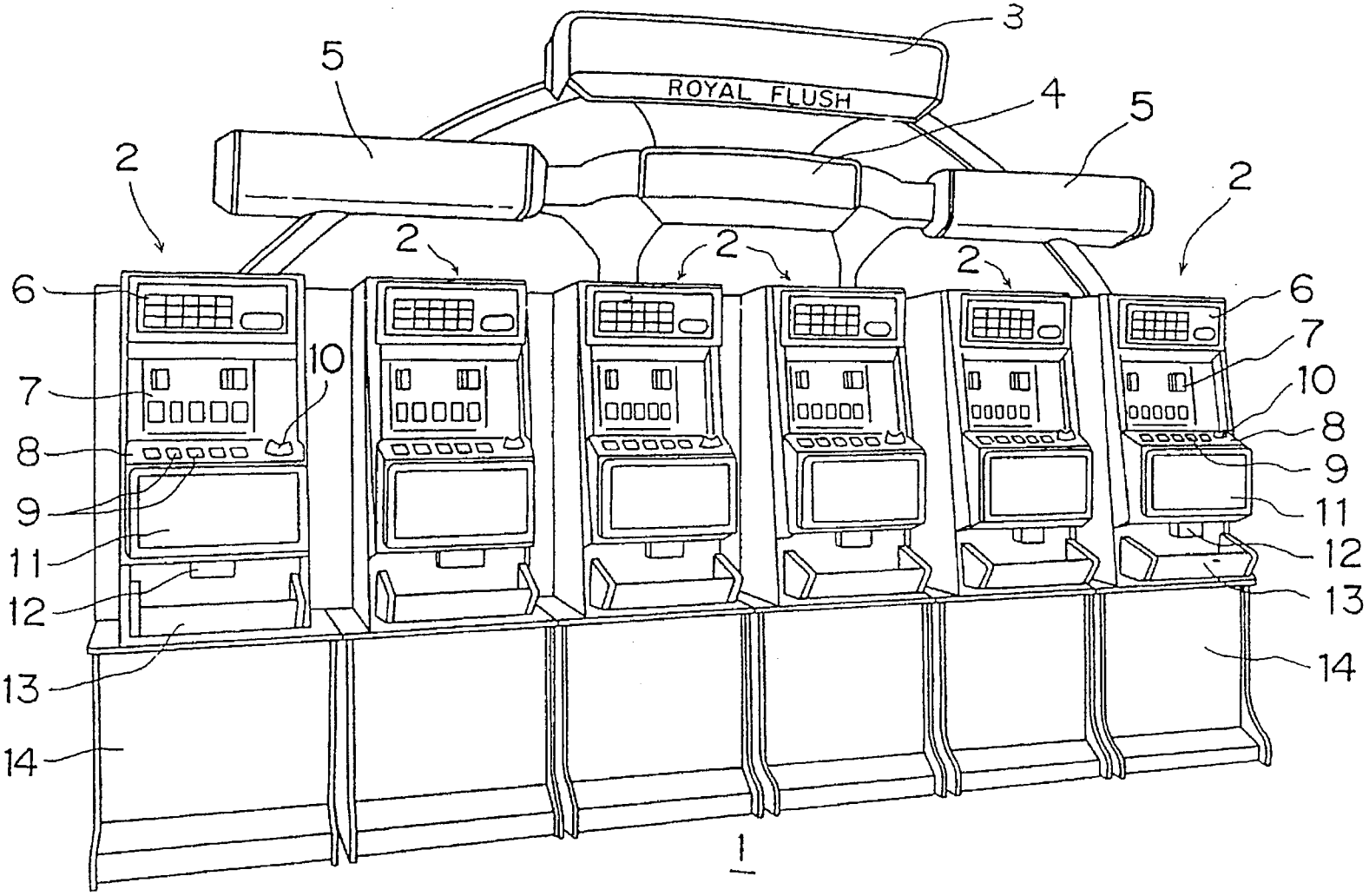
FIG. 1 is a perspective view of one embodiment of the present progressive gaming system.

Referring now to FIG. 1, a perspective view of one embodiment of a progressive gaming system according to the present invention is shown. A progressive gaming system 1 has a plurality of gaming controllers 2, which form one group.

In this embodiment, the gaming controllers 2 are used, for example, to play a poker game. The progressive gaming system 1 includes a display 3, which indicates a progressive bonus value, and which may, for example, be positioned on an upper central one of the plurality of gaming controllers 2 forming a line. In this example, since a poker game is played a ROYAL FLUSH is employed as the predetermined winning combination which triggers the progressive bonus. Display 3 indicates the progressive bonus value, when a player gets the winning combination of a ROYAL FLUSH.

Further, display 4, which indicates winning information, is positioned under display 3, and two ornamental displays 5 are positioned on the right and left sides of display 4.

Each of gaming controllers 2 forms a longitudinal rectangular box. A display 6 that indicates a kind of winning combination and odds per each winning combination is positioned on the upper front portion of each of the gaming controllers 2, a display monitor 7 is located under the display 6, and further, an operation pad 8 projects forward from, and is under, the display monitor 7.

Operation switches 9 are arranged together on the operation pad 8, and a coin inserting port 10 is provided to the right of the operation pad 8.

An ornament panel 11 is provided on the front surface of the operation pad 8. A coin paying out port 12 extends from the inside of the ornament panel 11 to transfer coins as reward to a coin tray 13.

Each of the gaming controllers 2 having the above-described structure is set on a supporting stand 14. The plurality of gaming controllers 2 may be centrally controlled as one group.

Figure 2:
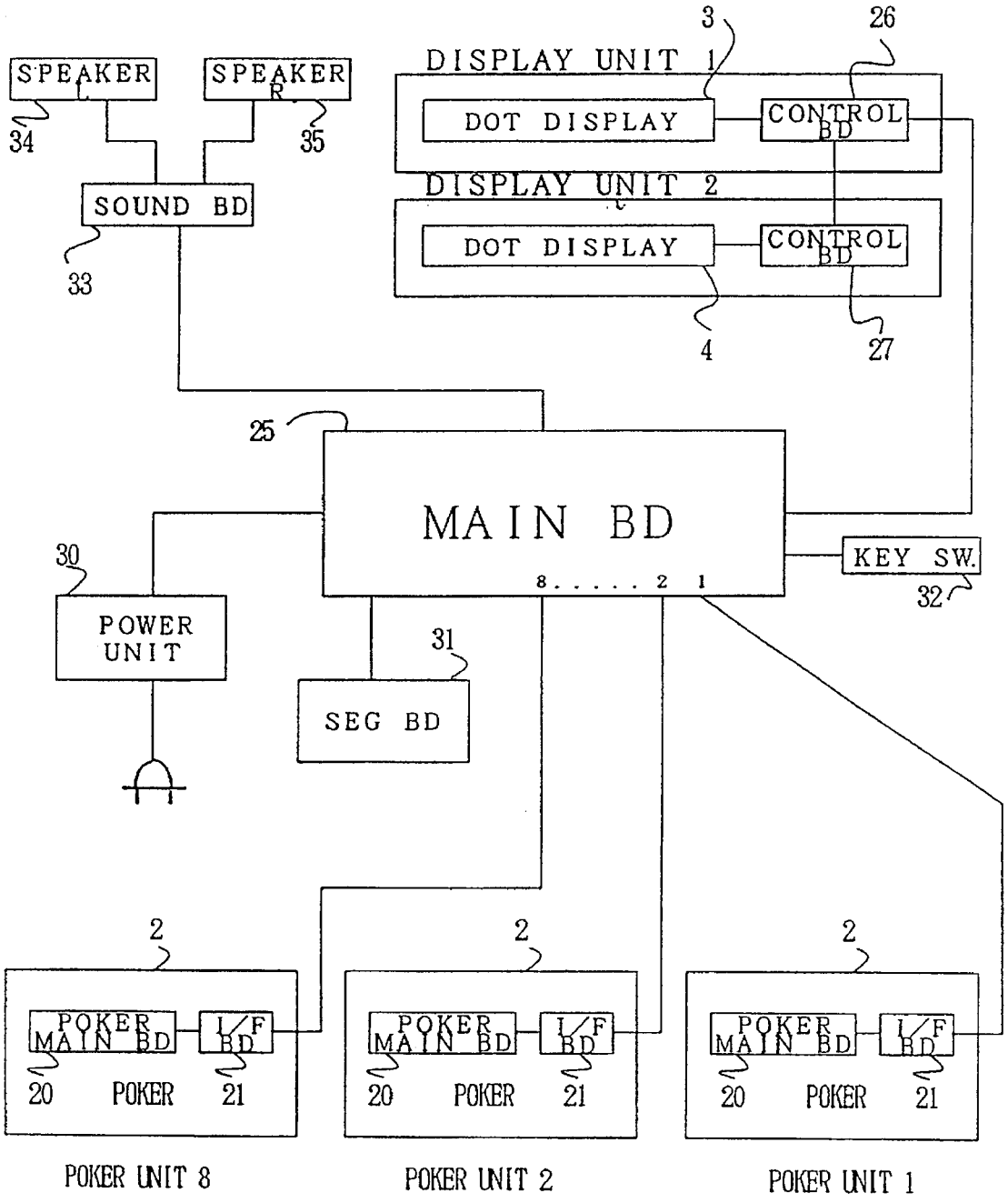
FIG. 2 is a block diagram showing one embodiment of the control circuits of the present progressive gaming system.

FIG. 2 illustrates a block diagram of an embodiment of the control circuits of the progressive gaming system of the invention. The operation of the circuits illustrated in FIG. 2 will be explained as follows.

Additionally, the progressive gaming system includes eight of the above-described gaming controllers 2 as an example. In this embodiment, the eight gaming controllers 2 are provided to play poker (hereinafter referred to as poker units 1 to 8).

In FIG. 2, the progressive gaming system has a master controller 25 for centrally controlling poker units 1 to 8. Power unit 30 supplies electrical power to the master controller 25. The master controller 25 controls a sound board 33 to output sound indication from right and left speakers 34 and 35. The controller 25 further controls control boards 26 and 27 to display the indication on the above-described displays 3 and 4 provided in the display units 1 and 2. A key switch 32 is used to supply the power to the system by an operator. A segment board 31 connecting to switches, displays or the like is also used to input initial values, and confirms data totaled by the operator. Each of the poker units 1 to 8 has a poker main board 20. The poker main board 20 controls each indication of information on a display monitor 7 and a coin paying out hopper for paying out coins to the coin paying out port 12 and so on (refer to FIG. 1).

Simultaneously, each poker unit 1 to 8 includes an input/output interface board 21 that transfers signals to and from a master controller 25, which, as noted above, centrally controls the eight poker units 1 to 8.

The master controller 25, formed of a microprocessor or the like, which is later discussed, controls the execution of the game in this embodiment of the progressive gaming system, according to a control program.

That is, each of the poker units 1 to 8 controls the distribution of a bet amount of coins (bet number). Further, the progressive bonus value is indicated on the progressive bonus indicating display 3, via the display control board 26. Furthermore, the number of the poker units 1 to 8, at which a player won the game, and the number of coins the player has won, are indicated on the winning information display 4.

The displays 3 and 4 may, for example, be dot display panels formed with LEDs arranged in matrices. The display control boards 26 and 27 decode indicating information of binary codes outputted from the master controller 25, convert the indicating information to driving signals, which are outputted corresponding to the indicating information, and have drivers for driving LEDs of the indicating panels on corresponding matrix positions by the driving signals.

FIG. 3 is an explanatory diagram of data transfer between the master controller 25 and each poker unit 1 to 8. The master controller 25 is connected via a communication line to each of the poker units 1 to 8. More particularly, each of eight serial ports SP1 to SP8 is connected to each corresponding interface board 21 of the poker units 1 to 8.

The master controller 25 sequentially drives the eight serial ports SP1 to SP8. After finishing the communication with one poker unit, the controller 25 starts to communicate with the next poker unit. In this way, the controller 25 sequentially communicates with the poker units 1 to 8 in a loop.

In this embodiment, the master controller 25 communicates with one poker unit for about 20 ms, during which the master controller 25 sends system information (described later), number of current deposited coins, and meter information to each poker unit. Also, each poker unit sends poker status, bet number, calendar setting, meter information requirements, or the like to the master controller 25.

In FIG. 3, the master controller 25 further sends the number of coins to be displayed, message display instructions, and registered information of message contents to the display units 1 and 2. The master controller 25 also sends instructions of music-playing number and music-playing stop to a sound board 33.

Figure 4:
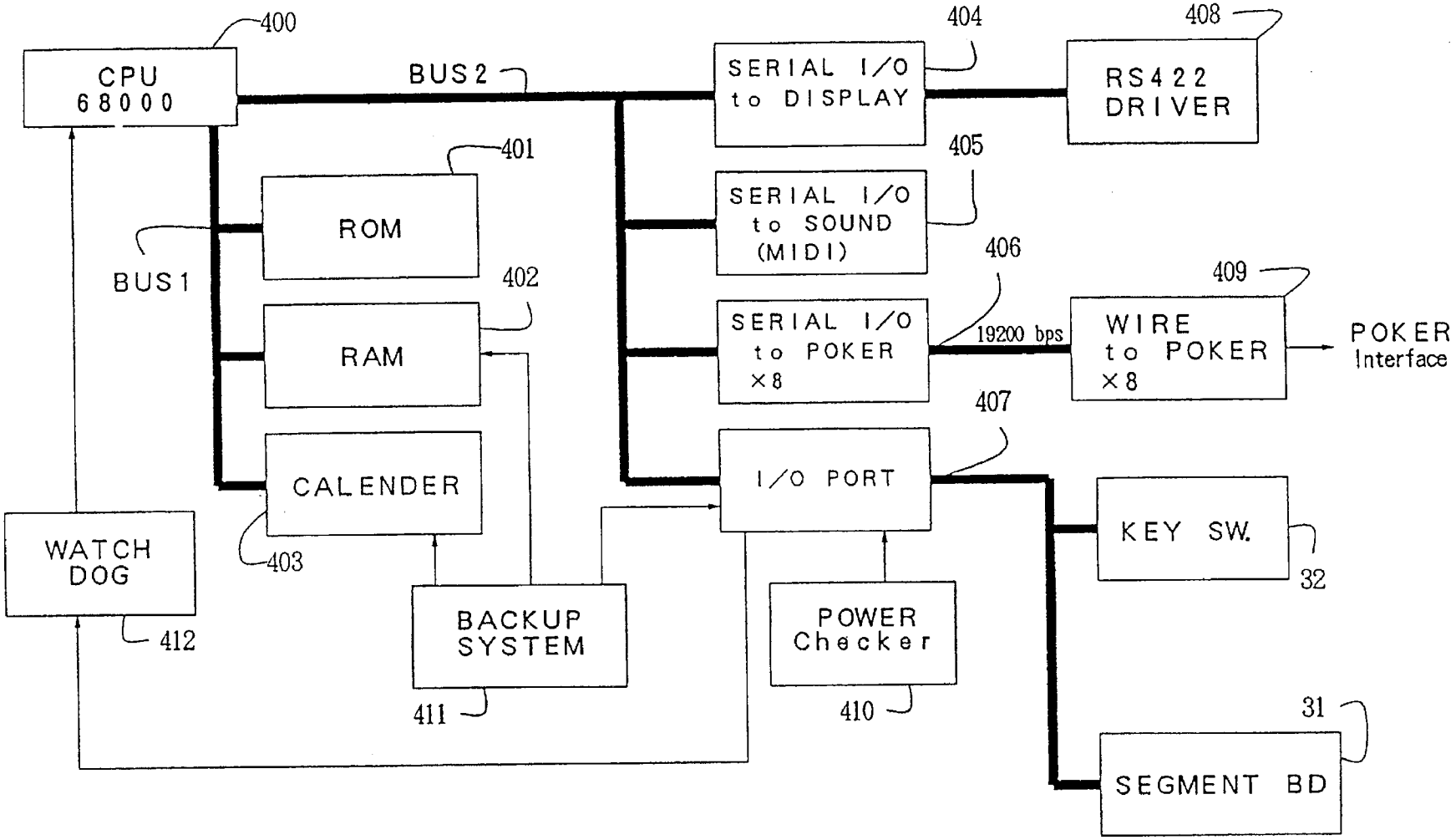
FIG. 4 is a block diagram showing one embodiment of the main board of the control circuits shown in FIG. 2.

FIG. 4 is an exemplary block diagram of the master controller 25. A CPU 400 could be a microprocessor of the 68000 series manufactured by Motorola Semiconductors to perform various arithmetic operations.

A ROM 401 is a Read Only Memory which stores a program for controlling the system. When the CPU 400 executes this program stored in the ROM 401, a game can be played. A RAM 402 is a working memory, which stores and reads out data during game execution.

A calendar circuit 403 stores a calendar information, which is always updated, such as data of year, month, day and time or the like. Then, the ROM 401, the RAM 402 and the calendar circuit 403 transfer data to and from the CPU 400 via a bus 1 (BUS1).

Further, the CPU 400 is connected to the first to fourth I/O circuits 404 to 407 via a bus 2 (BUS2). The first serial I/O circuit 404 receives serial data from the CPU 400 and sends them to a control board 26 of the display unit 1 via an RS 422 type driver circuit 408.

The second serial I/O circuit 405 sends MIDI data outputted from the CPU 400 to the sound board 33.

The third serial I/O circuit 406 corresponds to the serial ports SP1 to SP8 discussed in FIG. 3. The circuit 406 is connected to the corresponding interface circuit 21 of poker units 1 to 8 via a separate wire 409. In this embodiment, the speed of transmitting data between the I/O circuit 406 and each of serial ports SP1 to SP8 is 19200 bps.

Further, the fourth I/O circuit 407 interfaces with the key switch 32 and the segment board 31, which have been described above with respect to FIG. 2.

In FIG. 4, the main board 25 further has a power checker 410, a backup system 411 for saving data, and a watch dog timer 412.

Figure 5:
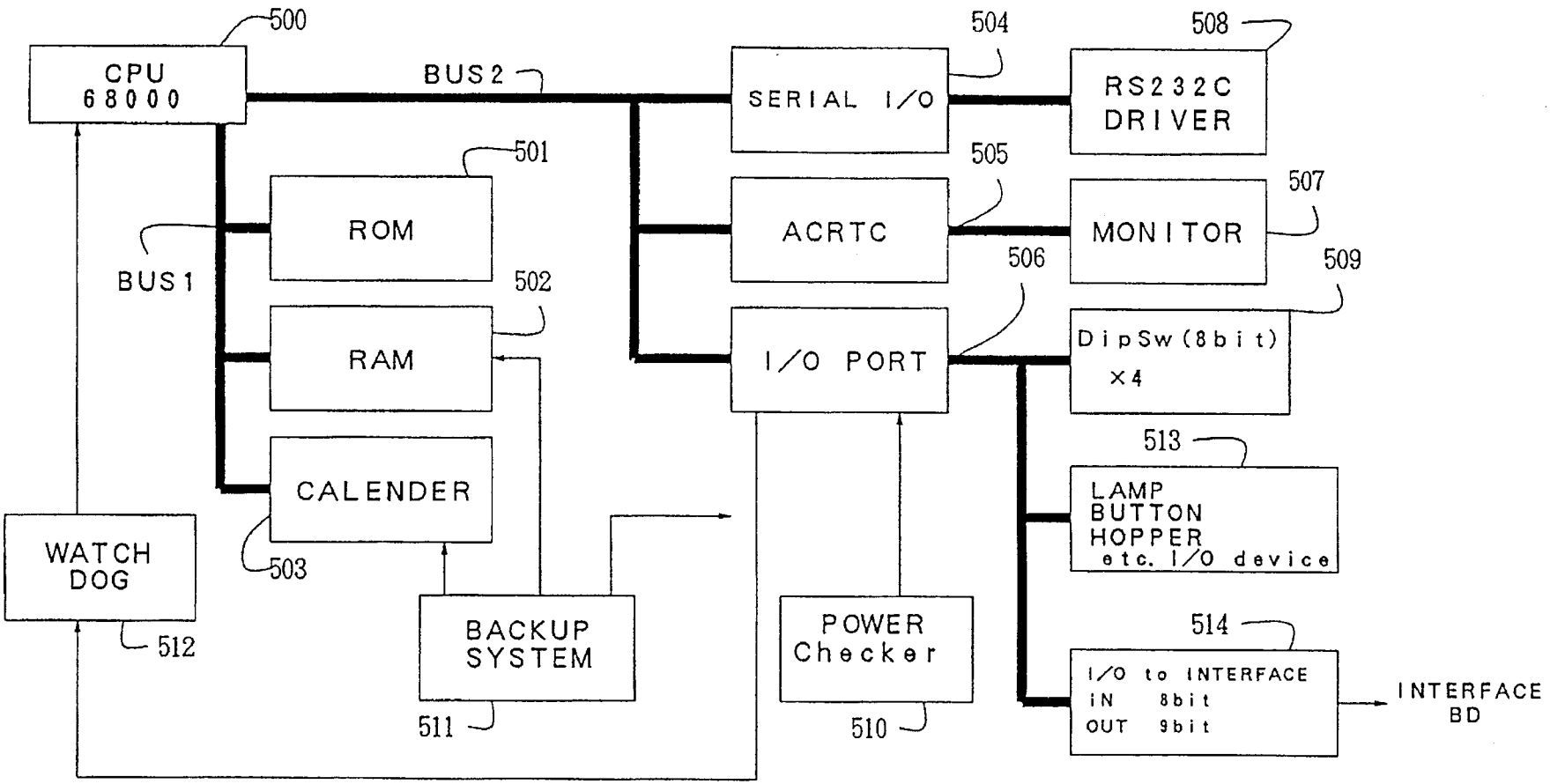
FIG. 5 is a block diagram of an embodiment of a poker unit main board of the control circuits shown in FIG. 2.

FIG. 5 is a structural block diagram of an embodiment of a poker main board 20 in each poker unit 1 to 8 as shown in FIG. 2. The poker main board is formed of CPU 500, which is a microprocessor of 68000 series, having the almost same structure as that of the master controller 25 shown in FIG. 4. The repeated explanation of the structure, therefore, will be omitted for simplicity.

In FIG. 5, a ROM 501, a RAM 502 and a calendar 503, which are connected to a bus 1 (BUS1), the first I/O circuit 504, a RS232C type driver 508, a power checker 510, a backup system 511 and a watch dog timer 512 respectively correspond to the ROM 401, the RAM 402, the calendar 403, the first I/O circuit 404, the RS422C type driver 408, the power checker 410, the backup system 411 and the watch dog timer 412, which are provided in the master controller 25 as shown in FIG. 4.

More particularly, the ROM 501 stores a control program for a poker unit. The ROM 501 is connected to display monitor 7 via the interface circuit 505, and interfaces with an interface board 21 via the I/O circuit 506 and I/O to Interface 514 of FIG. 5.

Further, dip switch 509 is used to initially set each poker unit 1 to 8 by an operator. A circuit 513 interfaces with I/O devices, such as a lamp, a button or the like.

Figure 6:
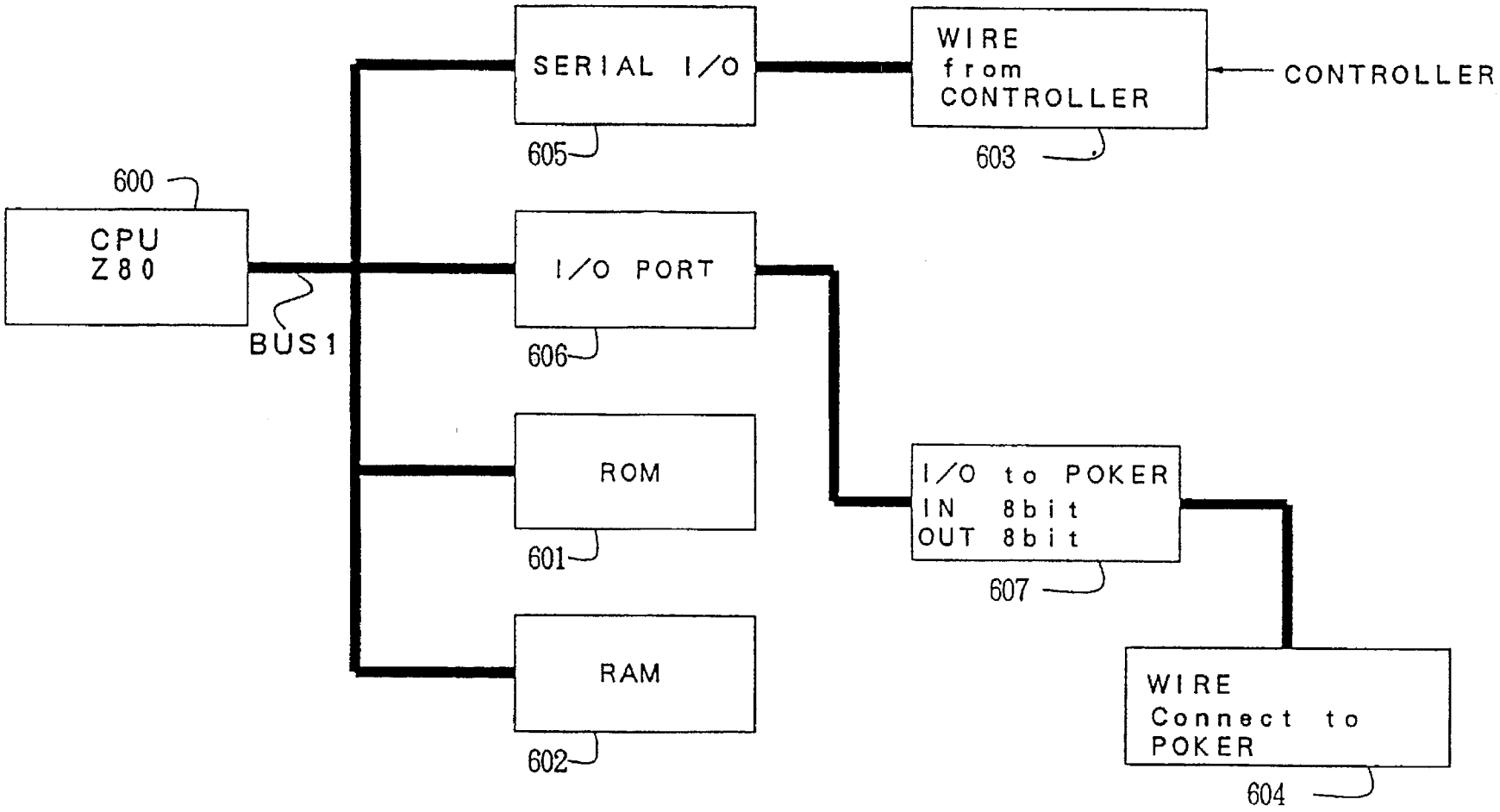
FIG. 6 is a block diagram of an embodiment of a poker unit I/F board of the control circuits shown in FIG. 2.

FIG. 6 is a structural block diagram of an interface board 21 in each of poker units 1 to 8. In FIG. 6, a CPU 600 could be a Z80 series micro-processor manufactured by Zilog Electronics, a U.S. company. The CPU 600 is connected to a ROM 601, a RAM 602, a serial I/O interface 605 and an I/O port 606, via a bus 1 (Bus1).

A control program, which controls interface function of the CPU 600, is stored in the ROM 601. The serial I/O interface 605 transfers signals via a wire 603 to/from the master controller 25. The I/O port 606 interfaces to transfer 8 bit signals to and from the poker units 1 to 8, via a wire 604 connected to each poker unit 1 to 8 (refer to 607 of FIG. 6).

With the above-described structures of the master controller 25 and the poker units 1 to 8, contents of the transferred data will next be considered in connection with FIGS. 7 to 12.

FIG. 7 shows an exemplary format for basic data packets employed to transfer data between the master controller 25 and each of poker units 1 to 8. The data packet is composed of a start text STX, an identification ID of each poker unit 1 to 8, sections of Command, Data Length, Data, End Text (ETX) and check bit (CRC).

When the master controller 25 sends data to each poker unit 1 to 8, the corresponding identification ID specifying a receiving poker unit is included in the data packet by the master controller 25. When the poker units 1 to 8 send data to the master controller 25, the identification ID of a sending poker unit is in the data packet.

FIG. 8 shows an exemplary format for a data request packet employed when the controller 25 or each poker unit 1 to 8 requests required data from each other. The packet is formed of a start text STX, an identification ID of a receiving or sending poker unit, Command and content of request (ENQ). After receiving a data request packet, the controller 25 or poker unit 1 to 8 sends a data packet, such as the one shown in FIG. 7, corresponding to the content of the request (ENQ).

Contents of the above-described data section (DATA) could be changed according to the specific command in the data request packet (see FIG. 8). The various contents of the data section (DATA) will be explained further below. Further, the present gaming system will be explained using the example of a poker 20 game.

FIG. 9 shows data sent from the master controller 25 to a poker unit requesting data, when the command of the data request packet is a set-request command. The data may be sent from the master controller 25 to the requesting poker unit when the requesting poker unit uses the data to set its timer to correspond to a standard timer of the master controller 25 at the time of initially setting the system or at the time of executing a testing of the system. For example, data of year Y, month M, day D, hour H, minute MT and second S, which are each formed with one byte, are placed in the data section DATA.

FIG. 10 shows data sent from the master controller 25 corresponding to a request command for display contents sent from each poker unit 1 to 8. More particularly, the data include system information.

System status data of 1 byte mean a flag indicating that a player wins with Jack Pot in an unspecified poker unit, and then a reward pay out is set in the system.

Royal Coin of 4 bytes refers to the number of coins paid out when the player wins with a Royal Flush. Double Coin refers to the number of coins paid out when the player wins with a Jack Pot when playing a double down game. Jack Pot Poker ID of 1 byte refer to an ID number of the poker unit where the player wins with a Jack Pot.

Further, Received Packet No. means a number of the packets received according to the status monitoring command.

Each poker unit indicates the received data on the display under the control of poker control board 20, when the poker unit receives the data corresponding to the request command for display contents.

FIGS. 11A and 11B show an example of a data packet sent from the master controller 25, corresponding to a meter content sending command sent from a poker unit. The data packet includes soft meters, such as the number of coins of various kinds, which are counted by a software, and the setting of the master controller 25.

More particularly, terms and phrases used in the data packet corresponding to a meter content sending command as shown in FIGS. 11A and 11B will be explained as follows.

PUSH refers to the situation where a player can obtain double coins if he draws a largest numbered card from three cards. If the player draws the smallest numbered card, he cannot obtain any coins. If the player draws a middle numbered card, the game is even, and then he is forced to deposit half of betted coins as bonus reward. The bonus reward may be paid out to the player who has obtained more than 100 coins in a double down game. The deposit and paying out of bonus coins is explained further below in connection with the execution of a game.

More particularly, in the present embodiment, it is defined that WAGER refers to the betted number in the poker game plus the betted number in the double down game.

TAKE refers to the number of coins paid out to players.

BIG BANG refers to a system in which one coin is separately deposited in another way than regularly deposited coins. If the number of deposited coins reaches a predetermined number, for example, 500 pieces in an embodiment of a game explained later, the deposited coins are paid out to all players. This is like a fever chance, i.e., a chance for realizing a large profit, where a player can continually win.

In FIGS. 11A and 11B, "JP" is an acronym for "Jack Pot."

Internal Amendment refers to the value of coins to be deposited, which have been prepared to be given to players who could not play the poker game with the best hand or who could not obtain any bonus coins. The deposited coins can be returned to the player at any time.

Over Limit refers to a limit in the number of coins indicated on display. In a later-discussed embodiment of the game, the limit is 19,999 coins or 9,999 coins. If the number of coins to be displayed becomes more than the limit, counting is stopped, and coins over the limit are stored.

FIG. 12 shows data sent from the master controller 25 corresponding to a last game sending command sent from the poker units 1 to 8. Contents of the data are sent from the master controller 25 when a poker unit requests the data of a Jack Pot generated by the gaming system in the past. Then, the controller 25 sends data having the same format for 25 blocks. The initial 5 blocks in the 25 blocks show the content of the last game of Royal Jack Pot. The remaining 20 blocks show the content of the last game of Jack Pot in a Double down game.

In FIG. 12, year Y to second S refers to a time when a Jack Pot is generated. COMB. refers to a section for judging whether the combination is Royal or Double. Further, Poker Number refers to the number of poker unit where a player wins with the Jack Pot. Jack Pot Numbers refer to the number of paid out coins when the players win with Jack Pot.

FIG. 13 shows data sent from each poker unit 1 to 8 to the master controller 25, corresponding to a status monitoring command generated periodically by the master controller 25. The CPU 400 of master controller 25 performs all internal calculations on the basis of the data.

Packet No. refers to a packet number of the currently sent data. Mode refers to a status of a poker unit, i.e., request of meter data, request of last data, the time of sending data, and indication whether paying out is TAKE (the number of coins paid out to the player) or BET (the number of coins obtained in the poker game added to the number of coins obtained in the double down game).

Further, BET refers to the number of inserted coins in the game. DOUBLE refers to the number of coins betted per a double down game. Internal Amendment refers to the number of amendment in the poker game. BANK refers to the number of forfeiting at the time of even in the double down game. Big Bang corresponds to a flag indicating that the Big Bang, which is one of the internal amendments, is generated.

COMB. NO. refers to a combination number at the end of the game. The master controller 25 notices that the Jack Pot is generated in any one of poker units 1 to 8, according to the combination number. Further, Payout corresponds to the number of WIN or WAGER generated in the poker units 1 to 8. Mode decides whether WIN or WAGER is sent. It should be noted that WAGER corresponds to the number of coins at winning and the TAKE corresponds to the number of coins paid out to the player, at last.

In the progressive gaming system 1 having the above-described structure, a procedure or method for controlling the game progression in the above described embodiment of the present invention will be explained based on the operating flow chart shown in FIG. 14. Further, an example of the game is provided in which the bonus is paid out when the winning combination of ROYAL FLUSH is formed in the poker game.

In FIG. 14, information relating to each of the judgment steps is transmitted from a poker unit 1 to 8 to the master controller 25 via the I/O interface 21. Based on the information, calculations and judgments are performed in the master controller 25. As the result, an instruction such as a control instruction for paying out the coins or the like is given to the corresponding poker unit 1 to 8. The poker unit 1 to 8 that receives the instruction executes a control corresponding to the control instruction by using its poker main board 20.

First, under the control of CPU 500, it is judged whether or not the End switch, which is one of the operation switches 9 (refer to FIG. 1), is pushed, based on a program stored in the ROM 501 of the poker main board 20 of each poker unit 1 to 8 (STEP S1). The End switch is pushed only at the end of a game. To start, a player drops coins into the coin slot 10, or the player bets coins on credit with a bet switch that is one of the operation switches 9.

Accordingly, each poker unit 1 to 8 counts the number of bet coins (bet count) (STEP S2). Then, it is judged whether or not the start switch, which is one of the operation switches 9, is pushed (STEP S3).

Steps 1, 2 and 3 are repeated until the start switch is pushed. The bet count is updated until the number of bet coins is eventually determined.

The player pushes the start switch when the number of bet coins is determined. Then, the count value of the bet coins is sent to the master controller 25. Each poker unit 1 to 8 sends a signal at that time to the master controller 25 as in the request command sent from the master controller 25 shown in FIG. 8 and shown in FIG. 7, as discussed above.

The master controller 25 collects all bet coins on the basis of the count value of the bet coins outputted from each poker unit 1 to 8, and adds, for example, two percent of the collected value to the progressively increasing bonus value (STEP S4). Further, the master controller 25 controls the updated bonus value to be indicated on the display 3 via the display control board 26 (STEP S6).

Then, the poker main board 20 controls the execution of the game in each poker unit 1 to 8 (STEP S6). The program for executing the game is already stored in a ROM 501 of the poker main board 20 in each poker unit 1 to 8. Further, it is also possible to store the program in another structure such as ROM 401 of the master controller 25, and each poker unit 1 to 8 reads it out to control the execution of the game.

Figure 15:
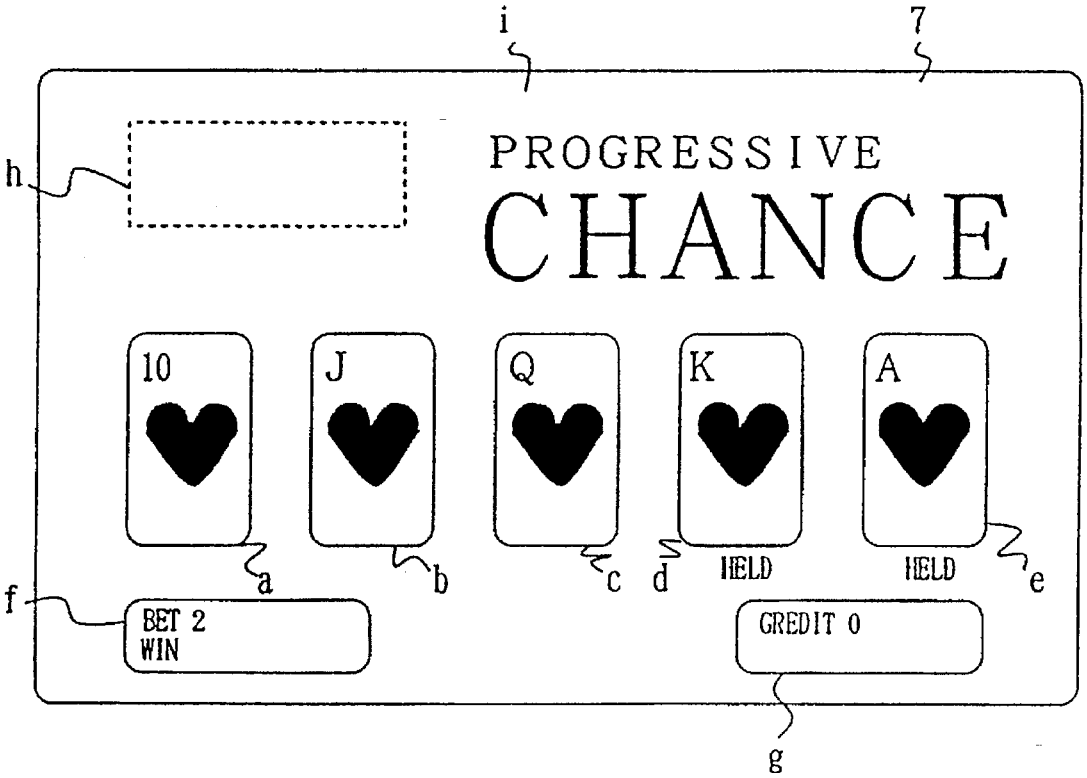
FIG. 15 is an explanatory diagram showing the game displayed on a display monitor of the progressive gaming system according to the present invention.

For example, as shown in FIG. 15, the distributed five cards placed face up are shown on the display monitor 7 (refer to FIG. 1). The player exchanges some pieces of cards from the distributed cards to get all cards of a target winning combination. It should be noted that the distribution of five cards and the exchange or display of cards may be controlled by a program stored in each poker unit 1 to 8 to execute the game, which is discussed above.

As a result, it is judged whether or not a winning combination is formed (STEP S7). If a winning combination is not formed, the operation returns to the step 1. If the winning combination is formed, it is judged whether or not the winning combination is a ROYAL FLUSH (STEP S8), which is the progressive bonus winning combination.

If the winning combination is other than ROYAL FLUSH, the number of coins won is calculated by multiplying the odds of getting the winning combination and the bet amount (STEP S14). Then, the number of coins won is indicated on the display monitor 7 (STEP S15). Then, the number of coins won is added to the player's credit (STEP S16), and the operation returns to the step S1.

Meanwhile, if the winning combination is a ROYAL FLUSH at step 8, it is judged whether or not the bet amount is the predetermined maximum value (STEP S9). In this embodiment, the maximum bet amount is 5. If the player bets the maximum bet amount (maximum bet), the flow directly goes to the next step 11. The above-described procedure is the same as that found in conventional gaming machines. That is, a player who does not bet the maximum bet has no chance of winning a progressive bonus.

In contrast, in the present invention, all players have a chance to receive the progressive bonus in a lottery. If the player doesn't bet the maximum bet amount, a lottery is performed (STEP S10). If the player wins the lottery, the flow chart goes to the step S11.

The lottery on the step S10 is performed in the case where the bet amount is less than 5. The program is set such that the winning probability is proportional to the bet amount.

When the lottery is lost at step S10, the operation goes to the step S14. The gained number of coins corresponding only to the winning combination is calculated (STEP S14), and is displayed on the display monitor 7 (STEP S15). Further, the gained number of coins is added to the credit (STEP S16) and the operation returns to the step S1.

When the player wins the lottery at step S10, or when it is judged that the bet amount is the maximum bet at step S9, the number of coins won is eventually calculated by adding the progressive bonus value to the number of coins, calculated by multiplying the bet amount to the odds of getting the winning combination of a ROYAL FLUSH (STEP S11).

Secondly, the number of coins won is indicated on the display monitor 7 of the corresponding poker unit 1 to 8, and together, the information of forming the winning combination of a ROYAL FLUSH and the number of coins won, calculated by adding the progressive bonus value, are sent to the master controller 25. Accordingly, the display 4 indicates the winning information under the control of the master controller 25.

Further, the master controller 25 drives the left and right speakers 34 and 35 to generate an effective sound, and simultaneously drives the strobe lamp 30 via the lamp drive board 29 to turn the ornament displays 5 on and off (STEP S12). The display 4 which indicates the winning information also indicates the number of the poker unit 1 to 8, at which a player gained the progressive bonus, to inform all players that the player won the progressive bonus.

Then, the master controller 25 resets and displays the initial value of the progressive bonus on the display 3 (STEP S13). Further, the number of coins won is added to the player's credit, and the operation returns to the step S1.

Returning to step S1, the player bets the coins to continue playing, and the player pushes the end switch to stop playing. If the End switch is pushed, the poker main board 20 causes the credited coins to be paid out through the coin paying out port 12 (STEP S17).

According to the above-described embodiment of the present invention, a chance to win a progressive bonus is unconditionally provided, not only to a player who bets the maximum number of coins, but to those who do not—via the lottery.

That is, all players have a chance to win the progressive bonus by forming the winning combination of a ROYAL FLUSH. Further, the lottery rationally relates the winning probability to the bet amount, so that a player's interest is aroused and maintained.

Figure 16:
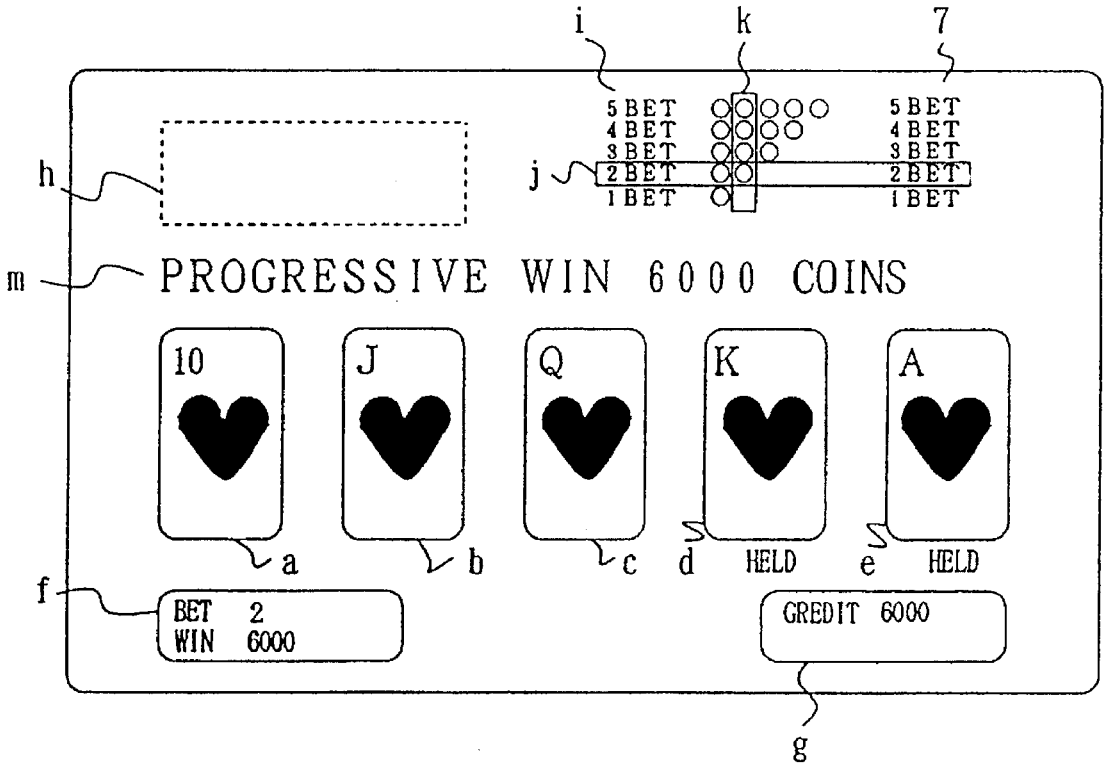
FIG. 16 is an explanatory diagram showing another scene of the same game displayed on the display monitor of the progressive gaming system shown in FIG. 15.

Referring now to FIGS. 15 and 16, the relationship of the winning probability and bet amount is explained. FIGS. 15 and 16 show explanatory diagrams which illustrate the display on the monitor 7 when the lottery is performed at step S10 as described in the flow chart of FIG. 14.

In FIG. 15, the same is started when the bet number is 2, the player has kept two cards d and e on the right sides of the arranged five player's cards a, b, c, d and e, and has exchanged the remainder three cards a, b and c. As a result, the player gets the winning combination of a ROYAL FLUSH. The display monitor 7 shown in FIG. 15 indicates the result immediately after completing the winning combination of a ROYAL FLUSH.

A BET, WIN indicating section f for indicating the bet number of coins and the gained number of coins is displayed at the left side of display 7 under the cards. A CREDIT indicating section g for indicating the number of credit is displayed at the right side of display 7 under the cards. In FIG. 15, "2" is indicated on the BET in the BET, WIN indicating section f, and there is no indication on the WIN in the BET, WIN indicating section f. "0" is indicated in the CREDIT indicating section g.

An odds indicating section h is displayed at the left side of display 7 above the player's cards and indicates the odds of getting a ROYAL FLUSH. A lottery indicating section i is displayed at the right side above the player's cards and displays "PROGRESSIVE CHANCE," immediately after the winning combination of ROYAL FLUSH is completed, to inform a player of a chance for gaining the progressive bonus.

This indication of "PROGRESSIVE CHANCE" is immediately turned off, and the indication is changed to a graphical display indication in the lottery indicating section i, as shown in FIG. 16, to execute the lottery.

In FIG. 16, the lottery indicating section i includes lines for indicating 5 to 1 BETs from top to bottom. Five circles 0 are arranged in the 5 BET line, four circles 0 are arranged in the 4 BET line, three circles 0 are arranged in the 3 BET line, two circles 0 are arranged in the 2 BET line, and one circle 0 is arranged in the 1 BET line. All of the circles put to the left 20 are arranged in a line, respectively. There are five circles in the first row, four circles in the second row, three circles in the third row, two circles in the fourth row, and one circle in the fifth row, that are arranged lengthwise from left to right.

Referring now to the case where the bet number of coins is 2, the 2 BET line is enclosed with the oblong bet indicating frame j, and the lengthwise lottery determining frame k moves from left to right, i.e., from the first row to the fifth row, enclosing circles, and stops after the fixed time.

If there is a circle at the place where the row determined bet indicating frame j meets the lottery determining frame k which has stopped, the player wins. The player loses if there is no circle at that place.

In the example shown in FIG. 16, the lottery determining frame k has stopped at the second row, and there is a circle at the place where the lottery determining frame k meets the BET indicating frame j. The player wins.

When the lottery determining frame k moves from left to right, the frame k stops at each line for a same interval. Therefore, players have a higher probability of winning if they bet more coins.

For example, if the player bets one, the winning probability becomes 1/5, whereas the winning probability becomes 4/5 if the player bets 4.

The five BET line is indicated temporarily. However, the winning probability is 100% (since, as noted above, 5 is the maximum bet amount of coins) if the player bets 5, so that the lottery described above is not performed, and he can receive the progressive bonus without the lottery (see steps S9 and S10 of FIG. 14).

In this way, as the lottery determining frame k moves from left to right in the lottery indicating section i, the player holds his breath and stares where the frame k stops, so that the player is more interested and excited.

When the lottery determining frame k stops in the second row, and determines the winning, as shown in FIG. 16, the indication of "PROGRESSIVE WIN 6000 COINS" is displayed on the indicating section m along the top side of the player's cards a, b, c, d, and e (if the player loses, an indication of "YOU LOSE" is displayed), and "6000" is indicated on the BET, WIN indicating section f.

"6000" is the result of the addition of the value obtained by multiplying the bet amount 2 to the odds of obtaining a ROYAL FLUSH, and the progressive bonus value. This indication of "6000" means the player gains 6000 coins. Accordingly, the indication on the CREDIT indicating section g changes "0" to "6000."

In the above-described embodiment, the maximum bet amount is 5, and the winning probability of the lottery is determined in proportion to the amount bet by the player, i.e., the winning probability becomes 1/5 if the bet number is 1, and 2/5 if the bet number is 2. However, it is possible to set the probability that is not always proportional to the bet amount. For example, the probability may be selected randomly or on the basis of some factor (e.g., time of day).

The predetermined winning combination for winning the progressive bonus is not limited to a ROYAL FLUSH, and other winning combinations may, of course, be within the scope of the present invention.

Since easier winning combinations are excessively advantageous for the players, it is preferable to set the winning combination at a certain level of difficulty, e.g., straight flush, "four of a kind." Further, a plurality of winning combinations may be set as a predetermined winning combination.

Further, the operation described with respect to FIGS. 15 and 16 can be executed by a microprocessor in the poker main board 20 according to a gaming program stored in the ROM 501 of the poker main board 20 of each poker unit 1 to 8.

Figure 17:
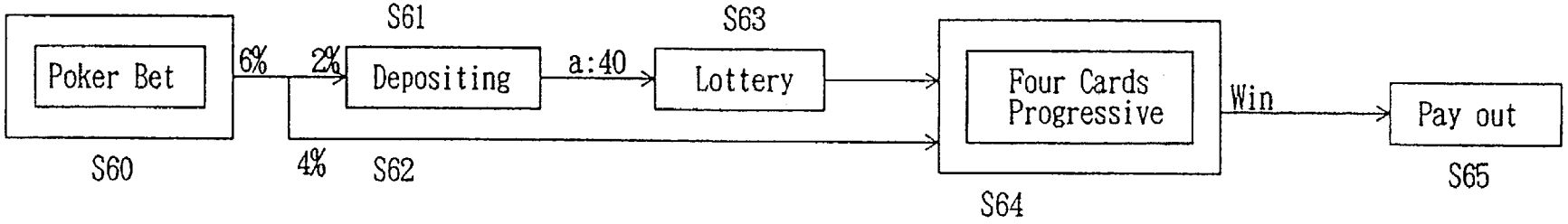
FIG. 17 shows an operation flow chart of another embodiment in which a progressive bonus value of a winning combination for the "four card" game is set according to the present invention.
Figure 18:
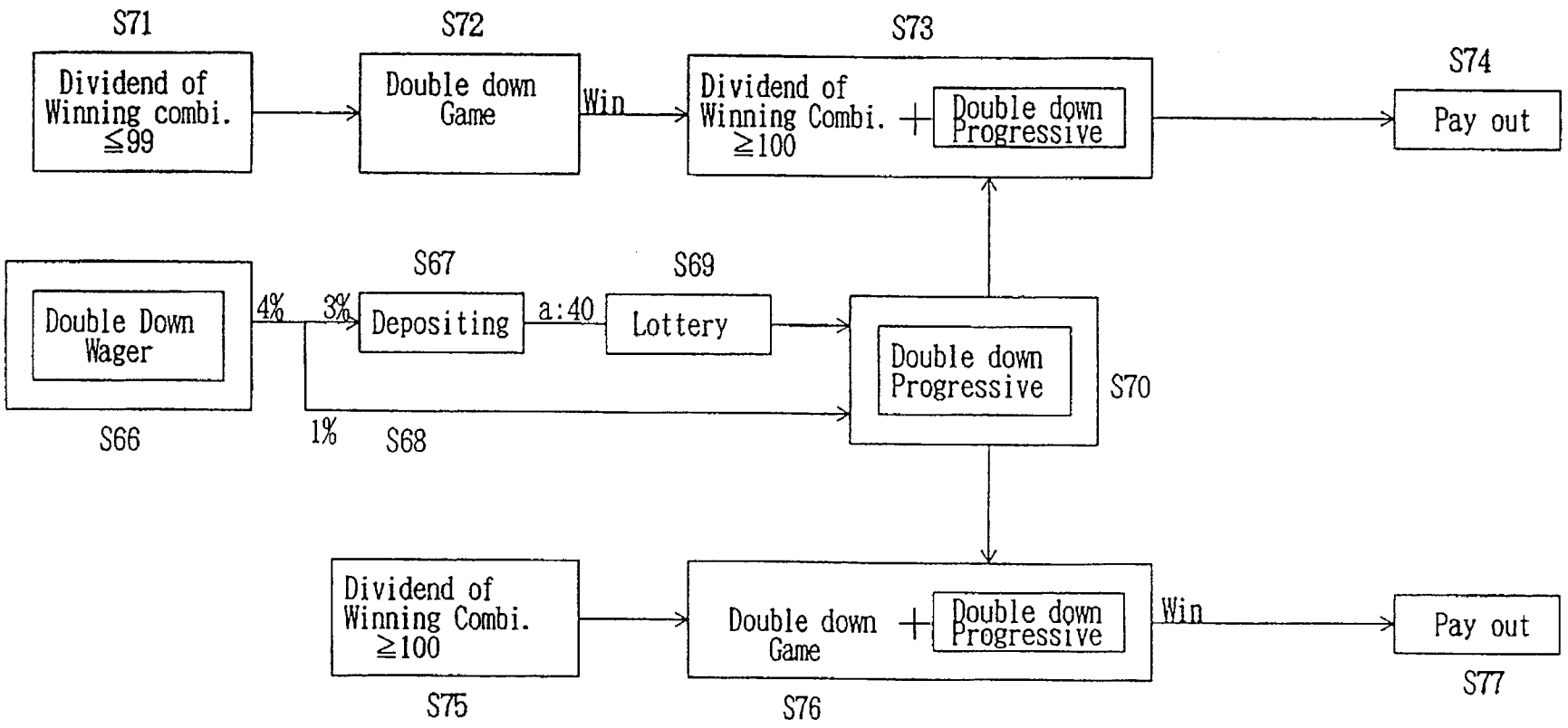
FIG. 18 shows an operation flow chart of the embodiment in which a progressive bonus value of a winning combination for the "double down" game is set according to the present invention.

FIGS. 17 and 18 show operating flow charts of another embodiment of the present invention which overcomes the drawbacks of the conventional systems in which the progressive bonus value always increases by a constant percentage per coin insertion, so that variation in play is poor, and the player's interest decreases. More particularly, FIGS. 17 and 18 show the present system of setting a progressive bonus.

Further, in this embodiment of the present invention, a game is the poker game. A progressive bonus for FOUR OF A KIND (four cards) in poker game and the progressive bonus in DOUBLE DOWN game are explained in FIGS. 17 and 18, respectively.

FIGS. 17 and 18 show the distribution of the progressive bonus processed by the master controller 25 shown in FIG. 2. FIG. 17 shows the setting of the progressive bonus value for the winning combination of "four of a kind" game in the poker unit 1 to 8 and FIG. 18 shows the setting of the progressive bonus value for a "double down" game.

The flow chart showing the distribution of the progressive bonus is executed according to the control program stored in the ROM 401 of the master controller 25.

The progressive bonus value of "four of a kind" game corresponds a bonus paid out other than by the usual distribution, when the player wins with the winning combination of "four of a kind" in the poker game at the poker units 1 to 8.

The progressive bonus value of "four of a kind" game is indicated on the display 3 for indicating the progressive bonus value of a ROYAL FLUSH, as described above relating to the first embodiment of the present invention, as well as the case of the winning combination of "four of a kind" game, too.

Meanwhile, the progressive bonus value of the DOUBLE DOWN game corresponds to a bonus, which is added to a usual bonus and is paid out when a player challenges the "double down" game under certain conditions and wins.

The DOUBLE DOWN game means a game in which a player can play in the case where he challenges to the game by pushing one double down game switch, which is one of the plural operation switches 9, when the player wins. In the game, the player can input a card selected from three trump cards displayed face downward on the display monitor 7. If a selected card has the largest number of the three cards, the player wins, and the player can gain the double reward of the BET amount.

Further, if the selected card has the smallest number of the three cards, the player loses, and his own BET is confiscated, so that there is no payout to the player. If the selected card has the middle number of three cards, this game ends in a tie, and the BET number of the player remains as it is.

At first, the operation of the distribution of the progressive bonus of "four of a kind" shown in FIG. 17 will be explained as follows.

In a poker game, each poker unit 1 to 8 sends the bet amount to the master controller 25 every time the player bets (STEP S60). The master controller 25 deposits two percent as a first percentage, of the bet amount into a deposited amount (STEP S61) and further adds four percent, as a second percentage of the bet amount to the progressive bonus value of "four of a kind," whenever the player bets (STEP S62). This calculation is performed on the CPU 400 of the master controller 25, in the same way as the above-described explanation relating to the first embodiment of the present invention.

Secondly, the progressive bonus value of "four of a kind" is set to an initial value of 200 coins, under the control of the master controller 25, and the initial value is indicated on the display 3. In the case where four percent of bet amount has the value less than 1 (i.e., right of decimal place), the value less than 1 is deposited into a deposited amount in the master controller 25, and added to the progressive bonus value.

Accordingly, the progressive bonus value of "four of a kind" increases gradually, every time the player challenges the game. The two percent of the bet number deposited as a bonus is added every time the player challenges the game and, when the added value reaches, for example, a selected value (lottery starting value) between 20 to 60 coins, the lottery is performed (STEP S63). This lottery may, for example, be the same as the operation at step S10 in the flow chart shown in FIG. 14.

In this embodiment, the depositing value for performing the lottery is selected to be 40 on average. The lottery will be performed as an embodiment for realizing the second feature of the present invention as follows.

If the depositing value of the target per a day is set to "2000", the lottery times per a day is supposed to 50 (=2000/40) times. Accordingly, each lottery is performed for each dividend having the respective fixed probability, as shown in FIG. 19.

For example, if the lottery is won at the winning probability of 1/50, all of the dividend 500 coins are added to the progressive bonus value of "four of a kind" at a stretch. However, there is a case where the lottery is won at the probability of 30/50, for which the dividend is 0.

That is, the lottery starting value is set between 20 to 60 coins. If the value reaches the set depositing value, the lottery is performed, and the dividend won at a certain probability is added to the progressive bonus value of "four of a kind" to indicate the bonus of "four of a kind" on the display 3. (STEP S64).

When the lottery starts, the speakers 34 and 35 generate the effective sound via the sound board 33, and together, the strobe lamp 30 turns on and off via the lamp driving board 29, to excite the player's interest. When the higher dividend is received, the sound and light are further changed effectively.

Accordingly, the lottery is performed unexpectedly to the player (STEP S63). Therefore, this excites and raises the interest of the player because of his chance of unexpectedly scoring a big win.

If the player wins the winning combination of "four of a kind," the player can be paid out the above-described progressive bonus of "four of a kind" other than the usual dividend of "four of a kind" (STEP S65), so that the player interest doubly increases.

Further, when the progressive bonus of "four of a kind" is paid out, the progressive bonus value of "four of a kind" is set to the initial value of 200 coins.

The above-described explanation is an exemplary operation of the distribution of the progressive bonus of "four of a kind" game.

Further, the operation of the distribution of the progressive bonus of the "double down" game shown in FIG. 18 will be explained.

At first, the player has a chance for challenging the "double down" game when he wins the poker game (STEP S66). The three percent of BET amount is deposited (STEP S67), and the one percent of BET amount is added to the progressive bonus value of the "double down" game (STEP S68), every time the player challenges the game.

The progressive bonus value of the "double down" game is set to an initial value of 0 (STEP S69).

Three percent of BET number deposited to a depositing amount every time the player challenges the game (STEP S67). The same lottery as the progressive lottery of "four of a kind" is performed when the value reaches the set lottery starting value (STEP S69).

Then, the dividend determined on the lottery is added to the progressive bonus value of the "double down" game, and indicated to the bonus value indicating section 4 of the "double down" game (STEP S70). The player can get a chance to have a great victory, if the larger dividend is determined on this lottery.

In the case where the dividend of the winning combination of the Poker game is below than 99 (STEP S71), the player challenges the "double down" game (STEP S72), and the progressive bonus value of the "double down" game indicated on the "Double Down" game indicating section 4 is added to the BET amount, when the player gains the win more than 100. Then, the accumulated value is indicated on the display monitor 7 in each of the poker units 1 to 8 (STEP S73), and together, "0" is indicated in the "double down" bonus indicating section 4 to announce that either of players challenges the "double down" game to gain the progressive bonus of the "double down" game.

The player gains the bonus of double the BET amount added to the progressive bonus value of the "double down" game on a win condition (STEP S74), whereas the bonus of the BET number is confiscated on a lose condition.

In the case where the dividend of the winning combination of the poker game is more than 100 (STEP S75), the progressive bonus value of the "double down" game is added to the BET number when the player challenges the "double down" game (STEP S76). The player can gain the bonus of double of the BET number on a win state (STEP S77), whereas the player cannot gain the bonus on a lose state.

The player interest is further increased in the above-described "double down" game, because the progressive bonus of the "double down" game increases largely unexpectedly.

Further, the percentage of depositing of the bet number, the percentage of the bet number added to the progressive bonus every time the player challenges the game, or the average of the lottery starting value, and further, the dividend or the winning probability shown in FIG. 19 can be modified with dip switches or the like connected to the master controller 25.

Figure 20:
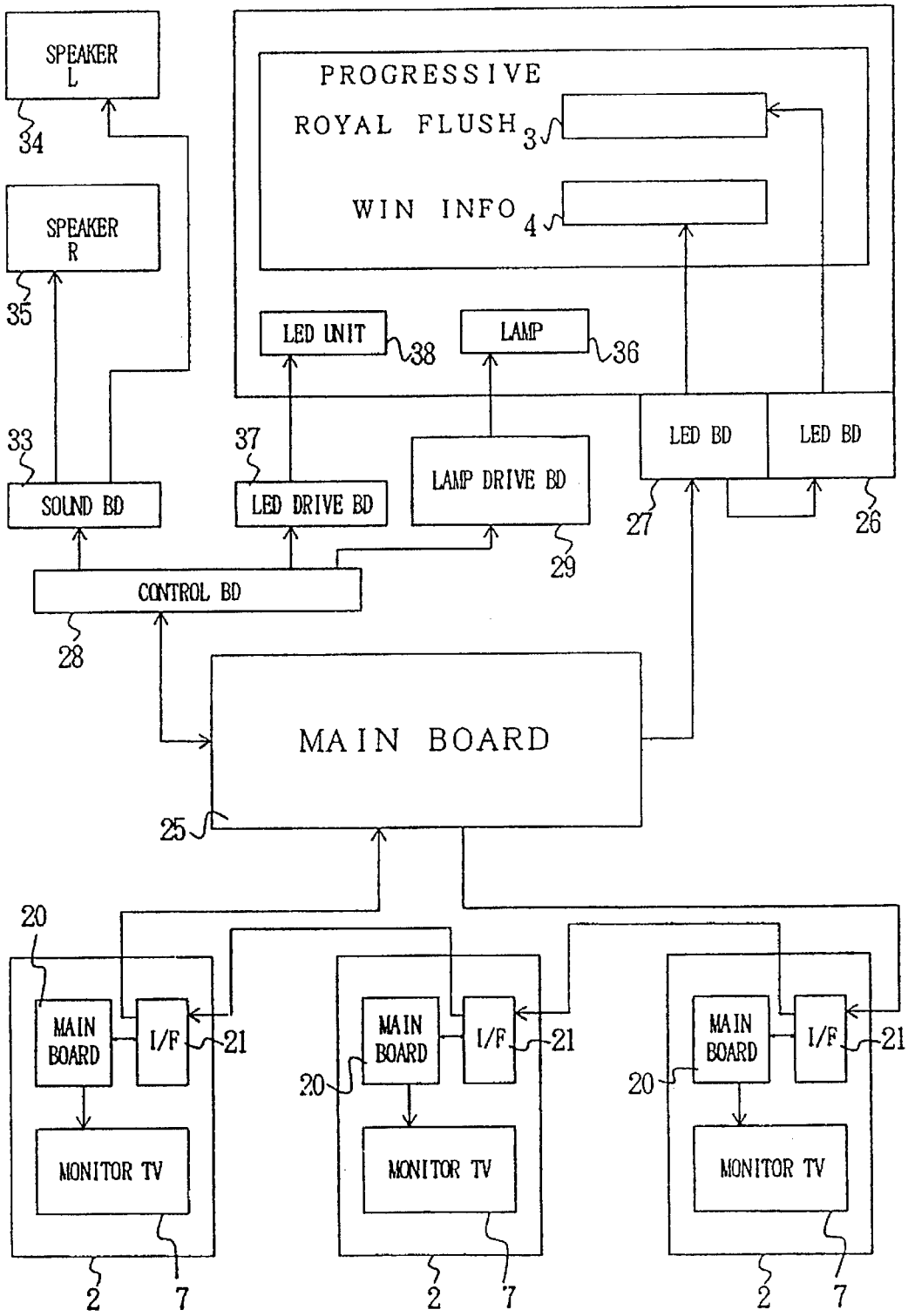
FIG. 20 is a block diagram showing another embodiment of the control circuits of the present progressive gaming system.

FIG. 20 shows another embodiment of the control circuit, different from the embodiment shown in FIG. 2 in that poker units 2 are connected in series or tandem to each other. Accordingly, the signal outputted from the master controller 25 is inputted to the I/O interface 21 in the first one of poker units 1 to 8. Then, the signal outputted from the master controller 25, which is passed through the I/O interface 21 in the corresponding poker unit 1 to 8 is inputted to the I/O interface 21 in the adjacent poker unit 1 to 8. In this way, the signal outputted from the master controller 25 is subsequently sent to the eight poker units 1 to 8 in series.

Then, the signal outputted from the I/O interface 21 in the last poker unit 8 is sent back to the master controller 25. Further, each poker unit 1 to 8 branches the signal inputted to the I/O interface 21, which is outputted from the master controller 25, and sends the branched signal to the poker main board 20.

Furthermore, the signal to be sent from the poker unit 1 to 8 to the master controller 25, e.g., the signal showing the operation status information of the poker unit 1 to 8, is outputted from the poker main board 20, and inserted with the I/O interface 21 to send them to the I/O interface 21 of the next poker unit 1 to 8 as described above.

The signal sent from the master controller 25 to each poker unit 1 to 8 and the signal sent from each poker unit 1 to 8 to the master controller 25 are added with the number of the poker unit 1 to 8 that should receive the signal and the number of poker unit 1 to 8 that has sent out the signal, and these signals are then sent out.

The control circuits shown in FIG. 20 further include a control board 28. The master controller 25 sends a sound signal to a sound board 33 via the control board 28. Simultaneously, the control board 28 turns on and off strobe lamps 36 built-in the ornament displays 5 (refer to FIG. 1) through a lamp driving board 29, and drives the other LED unit 38 through the LED driving board 37. The control board 28 further controls the indication of the effective sound by driving left and right speakers 34 and 35 through a sound board 33. In addition, it is possible to provoke a player's attention by switching the strobe lamp 30 via the lamp driving board 29, and further give variations of sound and lighting, if the player wins a high dividend.

In the above-described embodiments, a player can gain a progressive bonus, when the lottery is performed at the winning probability corresponding to the bet number if the player gets the predetermined winning combination for gaining the progressive bonus, in the first feature according to the present invention. Therefore, the first feature of the present invention brings the effectiveness of exciting the player interest, because it is rational that all the players are given chances for gaining the progressive bonus regardless of their bet numbers, and the winning probability is set according to the bet number on the lottery, thus holding the player's interest.

Further, the lottery is performed when the depositing number is reached to a randomly set lottery starting value, and the dividend obtained on certain probability is added to the progressive bonus value, so that the progressive bonus value largely increased unexpectedly in the second feature according to the present invention. Therefore, the second feature of the present invention brings the effectiveness of further exciting the player interest, because the progressive bonus value is largely increased unexpectedly, so that all players have a chance to obtain a large payout.

The above-described preferred embodiments are merely exemplary of the present invention, and other embodiments are also possible. More particularly, although a progressive game system executing a poker game has been described, other games, e.g., such as black jack, and such as a slot machine, can be used according to the present invention. It should of course, be understood that such other games and controllers are within the protective scope of the present invention.

What is claimed:

1. A progressive gaming system that pays out a progressively increasing bonus to a player who wins a game with a predetermined bonus winning combination among a plurality of predetermined winning combinations, the progressive gaming system comprising:

a plurality of gaming controllers for detecting when a player associated therewith gets one of said plurality of predetermined winning combinations and paying out a predetermined number of coins or tokens corresponding to said one winning combination, each of said plurality of gaming controllers counting coins or tokens bet by a player before a game is started and outputting an indication signal of the amount of the bet coins or tokens; and a master controller operatively connected to said plurality of gaming controllers for receiving the indication signal from each of said plurality of gaming controllers, adding a predetermined percentage of a total number of bet coins or tokens contained in each of the gaming controllers to a bonus value, performing a lottery when a player gets said predetermined bonus winning combination, and controlling said plurality of gaming controllers to pay out coins or tokens corresponding to a predetermined reward, including said bonus value, to said player having said predetermined bonus winning combination, if he wins the lottery.

2. The progressive gaming system according to claim 1, wherein said master controller adjusts a winning probability of the lottery according to the amount of bet coins or tokens.

3. The progressive gaming system according to claim 1, wherein the plurality of the gaming controllers are connected to the master controller in parallel.

4. The progressive gaming system according to claim 1, wherein the plurality of the gaming controllers are connected to the master controller in series.

5. The progressive gaming system according to claim 3, wherein each of the plurality of the gaming controllers has a display monitor, a main control board for controlling an indication to the display monitor and an I/O interface via which a signal is sent to and received from the master controller.

6. The progressive gaming system according to claim 4, wherein each of the plurality of the gaming controllers has a display monitor, a main control board for controlling an indication to the display monitor and an I/O interface via which a signal is sent to and received from the master controller.

7. The progressive gaming system according to claim 6, said gaming controllers are connected in series via their I/O interfaces and the signal outputted from the master controller is inputted to the I/O interface of a first one of said serially connected plurality of gaming controllers, and the output from the I/O interface of the last serially connected gaming controller is connected to said master controller.

8. A progressive gaming system that pays out a progressively increasing bonus to a player who wins a game with a predetermined bonus winning combination among a plurality of predetermined winning combinations, the progressive gaming system comprising:

a plurality of gaming controllers, each having means for detecting when a player gets one of said plurality of predetermined winning combinations, means for paying out a predetermined number of coins or tokens according to said one winning combination, means for counting coins or tokens bet by said player before the game is started, and means for outputting an indication signal of the amount of the bet coins or tokens; and a master controller operatively connected to said plurality of gaming controllers, said master controller having means for receiving the amount of the bet coins or tokens indicated by the indication signal from each of said plurality of gaming controllers, means for adding a predetermined percentage of the bet coins or tokens to a progressively saved bonus, means for performing a lottery when a player gets said predetermined bonus winning combination, and means for controlling each of the gaming controllers to pay out coins or tokens corresponding to a predetermined reward including said progressively saved bonus, to said player having said predetermined bonus winning combination, if he wins the lottery.

9. A progressive gaming system that pays out a progressively increasing bonus to a player who wins a game with a predetermined bonus winning combination among a plurality of predetermined winning combinations, the progressive gaming system comprising:

a plurality of gaming controllers for detecting when a player gets one of said plurality of predetermined winning combinations and paying out a predetermined number of coins or tokens corresponding to said one winning combination, each of the gaming controllers counting coins or tokens bet by the player before the game is started and outputting an indication signal of the amount of the bet coins or tokens; and a master controller operatively connected to the gaming controllers, said master controller comprising:

means for depositing in a deposited amount a first predetermined percentage of the amount of the bet coins or tokens indicated by the indication signals from said plurality of gaming controllers;

means for executing a lottery with a winning probability that corresponds to a dividend, when said deposited amount reaches a predetermined target value;

means for adding the dividend to said progressively saved bonus; and means for controlling each of the gaming controllers to pay out coins or tokens corresponding to a predetermined winning combination and to a progressively saved bonus.

10. The progressive gaming system according to claim 9, wherein the plurality of the gaming controllers are connected to the master controller in parallel.

11. The progressive gaming system according to claim 9, wherein the plurality of the gaming controllers are connected to the master controller in series.

12. The progressive gaming system according to claim 10, wherein each of the plurality of the gaming controllers has a display monitor, a main control board for controlling an indication to the display monitor and an I/O interface via which a signal is sent to and received from the master controller.

13. The progressive gaming system according to claim 11, wherein each of the plurality of the gaming controllers has a display monitor, a main control board for controlling an indication to the display monitor and an I/O interface via which a signal is sent to and received from the master controller.

14. The progressive gaming system according to claim 13, said gaming controllers are connected in series via their I/O interfaces and the signal outputted from the master controller is inputted to the I/O interface of a first one of said serially connected plurality of gaming controllers, and the output from the I/O interface of the last serially connected gaming controller is connected to said master controller.

15. The progressive gaming system according to claim 5, wherein the master controller sends the signal to and from the plurality of gaming controllers one by one in parallel.

16. The progressive gaming system according to claim 10, wherein the master controller sends the signal to and from the plurality of gaming controllers.

17. A progressive gaming method that pays out a progressively increasing bonus to a player who wins a game with a predetermined bonus winning combination among a plurality of predetermined winning combinations, the progressive gaming method comprising the following steps:

counting coins or tokens bet by a player before a game is started;

outputting an indication signal representing the amount of bet coins or tokens;

adding a predetermined percentage of a total number of bet coins or tokens to a bonus value;

detecting that a player gets one of said plurality of predetermined winning combinations;

performing a lottery when said player gets said predetermined bonus winning combination; and paying out coins or tokens corresponding to a predetermined reward including said bonus value if the lottery is won.

18. The progressive gaming method according to claim 17, further comprising the step of adjusting a winning probability of the lottery according to the amount of bet coins or tokens.

19. A progressive gaming method that pays out a progressively increasing bonus to a player who wins a game with a predetermined bonus winning combination among a plurality of predetermined winning combinations, the progressive gaming method comprising the following steps:

counting coins or tokens bet by a player before the game is started;

outputting an indication signal representing the amount of bet coins or tokens;

adding a predetermined percentage of the bet coins or tokens to a progressively saved bonus;

detecting that a player gets one of said plurality of predetermined winning combinations;

performing a lottery when the player gets a predetermined bonus winning combination; and paying out coins or tokens corresponding to a predetermined reward including said progressively saved bonus when the lottery is won.

20. A progressive gaming method that pays out a progressively increasing bonus to a player who wins a game with a predetermined bonus winning combination among a plurality of predetermined winning combinations, the progressive gaming method comprising the steps:

counting coins or tokens bet by a player before a game is started;

outputting an indication signal of the amount of the bet coins or tokens;

depositing in a deposited amount a first predetermined percentage of the total amount of the bet coins or tokens indicated by the indication signals for all players;

saving a second predetermined percentage of the total amount of the bet coins or tokens indicated by the indication signals for all players to a progressively saved bonus;

executing a lottery with a winning probability that corresponds to a dividend, when the deposited amount reaches a predetermined target amount;

adding the dividend to the progressively saved bonus when the lottery is won;

detecting that a player gets a predetermined bonus winning combination among the plurality of predetermined winning combinations; and paying out a reward of coins or tokens corresponding to the predetermined bonus winning combination, including the progressively saved bonus.

21. A progressive game system that pays out a progressively increasing bonus to a player who wins a game with a predetermined bonus winning combination among a plurality of predetermined winning combinations, the progressive gaming system comprising:

a plurality of gaming controllers for detecting when a winning player gets one of said plurality of predetermined winning combinations and paying out a predetermined number of coins or tokens corresponding to said one winning combination, each of said plurality of gaming controllers counting coins or tokens bet by a player before a game is started and outputting an indication signal of the amount of the bet coins or tokens; and a master controller operatively connected to said plurality of gaming controllers for adding a predetermined percentage of a total number of bet coins or tokens contained in each of the gaming controllers to a bonus value, performing a lottery when a winning player gets said predetermined bonus winning combination and has bet less than a maximum bet amount, and controlling said plurality of gaming controllers to pay out coins or tokens corresponding to the predetermined bonus winning combination and the bonus value, if the winning player wins the lottery with a winning probability corresponding to the bet amount.

22. The progressive gaming system according to claim 21, wherein the master controller adjusts a winning probability of the lottery according to amount of bet coins or tokens.

23. The progressive gaming system according to claim 21, wherein the plurality of the gaming controllers are connected to the master controller in parallel.

24. The progressive gaming system according to claim 21, wherein the plurality of the gaming controllers are connected to the master controller in series.

25. The progressive gaming system according to claim 23, wherein each of the plurality of the gaming controllers has a display monitor, a main control board for controlling an indication to the display monitor and an I/O interface via which a signal is sent to and received from the master controller.

26. The progressive gaming system according to claim 24, wherein each of the plurality of the gaming controllers has a display monitor, a main control board for controlling an indication to the display monitor and an I/O interface via which a signal is sent to and received from the master controller.

27. The progressive gaming system according to claim 26, said gaming controllers are connected in series via their I/O interfaces and the signal outputted from the master controller is inputted to the I/O interface of a first one of said serially connected plurality of gaming controllers, and the output from the I/O interface of the last serially connected gaming controller is connected to said master controller.

28. A progressive gaming system that pays out a progressively increasing bonus to a player who wins a game with a predetermined bonus winning combination among a plurality of predetermined winning combinations, the progressive gaming system comprising:

a plurality of gaming controllers, each having means for detecting when a winning player gets one of said plurality of predetermined winning combinations, means for paying out a predetermined number of coins or tokens according to said one winning combination, means for counting coins or tokens bet by said player before the game is started, and means for outputting an indication signal of the amount of the bet coins or tokens; and a master controller operatively connected to said plurality of gaming controllers, said master controller having means for receiving the amount of the bet coins or tokens indicated by the indication signal from each of said plurality of gaming controllers, means for adding a predetermined percentage of the bet coins or tokens to a progressively saved bonus, means for controlling each of the gaming controllers to pay out coins or tokens corresponding to a predetermined reward including said progressively saved bonus when a player gets said predetermined bonus winning combination and has bet a predetermined maximum bet amount; means for performing a lottery when the player gets said predetermined bonus winning combination and has bet less than said maximum bet amount, said lottery giving said winning player a chance to win said predetermined reward, even if said winning player has bet less than said maximum bet amount.

29. The progressive gaming system according to claim 25, wherein the master controller sends signals to and from the plurality of gaming controllers one by one in parallel.

30. A progressive gaming method that pays out a progressively increasing bonus to a player who wins a game with a predetermined bonus winning combination among a plurality of predetermined winning combinations, the progressive gaming method comprising the steps:

counting coins or tokens bet by a player before a game is started;

outputting an indication signal of the amount of the bet coins or tokens;

adding a predetermined percentage of a total number of bet coins or tokens by all players to a bonus value;

detecting when a winning player gets one of said plurality of predetermined winning combinations;

when said winning player gets said predetermined bonus winning combination, paying out the coins or tokens corresponding to a predetermined reward including said bonus value, if said winning player has bet a maximum bet amount; and performing a lottery if said winning player has bet less than said the maximum bet amount, said lottery giving said winning player a chance to win said predetermined reward even though he has bet less than said maximum bet amount.

31. The progressive gaming method according to claim 30, further comprising the step of adjusting a winning probability of the lottery according to the coins or tokens that the winning player has bet.

32. A progressive gaming method that pays out a progressively increasing bonus to a player who wins a game with a predetermined bonus winning combination among a plurality of predetermined winning combinations, the progressive gaming method comprising the steps:

detecting when a winning player gets one of said plurality of predetermined winning combinations;

counting coins or tokens bet by all player's before the game is started;

adding a predetermined percentage of the bet coins or tokens to a progressively saved bonus;

paying out coins or tokens corresponding to a predetermined reward including said progressively saved bonus when said winning player gets said predetermined bonus winning combination and has bet a predetermined maximum bet amount;

performing a lottery when said winning player gets said predetermined bonus winning combination and has bet less than said predetermined maximum bet amount, said lottery giving said winning player a chance to win said predetermined reward even if said winning player has bet less than said maximum bet amount.

33. The progressive gaming system according to claim 9, wherein the master controller further has means for saving in the progressively saved bonus a second predetermined amount of the bet coins or tokens indicated by the indication signals from the plurality of gaming controllers.

34. The progressive gaming system according to claim 21, wherein the master controller does not perform the lottery when the winning player has bet the maximum bet amount, and controls the gaming controllers to pay out the coins or tokens corresponding to the predetermined bonus winning combination and the bonus value to the winning player without performing a lottery.

* * * * *